United States Patent [19]

Ellwanger et al.

[11] 4,170,091

[45] Oct. 9, 1979

[54] APPARATUS FOR RESHARPENING CUTTING BLADES FOR GEAR CUTTING MACHINE

[75] Inventors: Charles G. Ellwanger; Harry Pedersen, both of Rochester, N.Y.

[73] Assignee: The Gleason Works, Rochester, N.Y.

[21] Appl. No.: 831,013

[22] Filed: Sep. 6, 1977

Related U.S. Application Data

[63] Continuation-in-part of Ser. No. 812,197, Jul. 5, 1977.

[51] Int. Cl.[2] ..... B24B 53/02; B24B 3/34

[52] U.S. Cl. ..... 51/5 D; 51/134; 51/218 T

[58] Field of Search ..... 51/5 D, 131 R, 134, 51/216 T, 217 T, 218 A, 218 T, 237 T, 288, 327

[56] References Cited

U.S. PATENT DOCUMENTS

| | | | |
|---|---|---|---|
| 2,204,714 | 6/1940 | Wildhaber | 51/288 X |
| 2,210,273 | 8/1940 | Wildhaber | 51/288 X |
| 2,231,762 | 2/1941 | Johanson | 51/288 X |
| 2,332,420 | 10/1943 | Wildhaber | 51/288 X |
| 2,629,973 | 3/1953 | Candee | 51/288 |
| 2,647,352 | 8/1953 | Lamberty | 51/288 X |
| 3,156,074 | 11/1964 | Baltz | 51/288 X |
| 3,178,857 | 4/1965 | Grob | 51/288 X |
| 3,881,889 | 5/1975 | Hunkeler | 51/288 |

*Primary Examiner*—Gary L. Smith

*Attorney, Agent, or Firm*—Morton A. Polster; Ralph E. Harper

[57] ABSTRACT

An improved apparatus for sharpening and resharpening cutting blades provides for very accurate positioning of a plurality of cutting blades relative to a single grinding plane for a grinding wheel. The apparatus includes means for positioning the cutting blades in precise relationships to a reference axis so that the reference axis can be used for establishing critical geometric surfaces on the cutting blades.

22 Claims, 16 Drawing Figures

APPARATUS FOR RESHARPENING CUTTING BLADES FOR GEAR CUTTING MACHINE

RELATED APPLICATIONS

This application is a continuation-in-part of U.S. Application Ser. No. 812,197, filed July 5, 1977 in the names of Charles G, Ellwanger and Harry Pedersen, and entitled "Method for Resharpening Cutting Blades for Gear Cutting Machinery".

BACKGROUND AND SUMMARY OF THE INVENTION

As pointed out in U.S. Pat No. 3,881,889 (commonly owned herewith), dimensional relationships and closeness of tolerances are extremely important in the design and manufacture of certain cutting tools, such as those used with gear cutting machinery capable of generating tooth profiles for spiral, bevel, hypoid, and other types of gears. The geometry of cutting blades for such machinery has been relatively complex in order to accomodate geometric changes which may be desired or required in the finished gear products. As a result of these special requirements, for cutting tools of this type, there has been a long history of manufacture and usage of cutting tools which are relatively complex and costly in terms of design and ease of manufacture.

Recently, there have been efforts to simplify the geometry and design of cutting blades used in gear cutting applications, and applicants herein have themselves filed U.S. Application Ser. No. 812,197 on July 5, 1977 on the subject of an improved method for resharpening such cutting blades. That same application discloses apparatus for carrying out the claimed method, and this present application is directed to a disclosure of specific apparatus being designed and built by The Gleason Works, Rochester, N.Y. for carrying out high production sharpening and resharpening of various forms of cutting blades and other tools. Although this invention is directed primarily to the special problems of maintaining critical tolerances and relationships in cutting tools designed for spiral, bevel, and hypoid gears, it should be appreciated that the apparatus disclosed herein may be used to produce cutting tools for other forms of gears (such as spur and helical gears) and additionally may be used for sharpening and resharpening cutting tools used for milling or other stock removal applications.

Various forms of equipment have been designed for carrying out specialized grinding operations for sharpening tooling for machines. For example, it is known to provide for a swinging motion of a tool relative to a grinding wheel so as to produce a preferred end configuration on the tool. Patents disclosing this general concept appear to be directed primarily to methods and apparatus for sharpening drill bits in which a conical end profile is required for each drill bit, as exemplified in U.S. Pat. Nos. 2,471,443; 3,535,831; 3,656,264; and 3,838,540.

It is also known to provide for batch grinding of relatively simple cutting blades designed for use in gear cutting applications, as shown in U.S. Pat. Nos. 2,367,494 and 3,487,592. These types of grinding, and the tooling being ground or resharpened, are closely related to the specific subject matter of the present invention inasmuch as the intent here is to provide production apparatus for precision grinding a plurality of gear cutting blades. However, as far as is known by applicants herein, prior art efforts to resharpen precision cutting blades have not fully satisfied the production requirements of major users of gear cutting machinery. For one reason or another the types of equipment which have been tried require unacceptably long periods of time for changing blade batches and do not appear to offer full dimensional control over a range of blade profiles to be sharpened in a precision production process. Accordingly, it is believed that the apparatus described and claimed herein represents an improvement over prior art efforts in this field.

In accordance with the present invention all critical surfaces of cutting blades are formed and established in what amounts to a single grinding plane of a grinding wheel. This single grinding plane may be considered a flat plane for many typical grinding operations contemplated herein, but it is also intended that the terminology "single grinding plane" include grinding wheel surfaces which have been shaped to produce special profiles on cutting blades. In contrast to what will be described herein as a "single grinding plane", the grinding equipment illustrated in U.S. Pat. No. 3,881,889 (commonly owned herewith) requires the use of separate grinding planes 66 and 68 (FIGS. 7 through 11 thereof) of a grinding wheel in order to carry out all steps of resharpening of a cutting blade of the type shown. Grinding wheels which are designed and manufactured with multiple grinding planes are far more costly to purchase and more difficult to maintain than grinding wheels of simpler design which include only a single grinding plane for carrying out all operations. In order to take advantage of a single grinding plane, however, it is necessary to provide apparatus which can orient a batch of cutting blades into different positions relative to the single plane of the grinding wheel. The present invention does this with an arrangement of tool-holding equipment which permits set-up of the machine with only a single reference axis for determining initial and all subsequent positions of a batch of tools relative to the single grinding plane. Thus, the basic approach of the present invention is a significant one inasmuch as it permits the use of simpler and less costly grinding wheels and dressers for establishing critical relationships on cutting blades.

As pointed out in the parent application Ser. No. 812,197, mentioned above, it is important that certain relationships be established between individual cutting blades to be sharpened and the single grinding plane of a grinding wheel. In addition, it is important in grinding operations of this type, which necessarily involve a series of steps of separate grinding contacts with a grinding surface, to precisely locate each surface being ground with reference to other surfaces which were previously ground or which will be subsequently ground. Maintenance of correct relationships, and even knowing precisely where a workpiece is located at all times relative to a grinding surface, become more difficult as more and more workpieces are introduced into each grinding cycle. Thus, the problems of correctly relating a single cutting blade to a grinding surface become greatly increased when a plurality of cutting blades are being handled at the same time. The apparatus of this invention solves these problems, and additionally, offers higher production rates than have been achieved heretofore for cutting blades and other tooling of this type.

In its broadest form the apparatus of the present invention comprises a machine having a base structure, a grinding wheel assembly mounted at one end of the base structure, and a cradle assembly mounted at an opposite end of the base structure. Preferrably the base has an inclined upper surface for supporting essential components of the machine, and this permits mounting of the grinding wheel assembly at a lower level of the surface for movement towards and away from the mounted position of a plurality of cutting blades carried by the cradle assembly at an upper level of the base structure. The cutting blades are secured in a tool-holding means which permits orientation of common selected surfaces of all of the cutting blades toward the grinding plane of the grinding wheel. In its preferred embodiment the tool-holding means comprises a ring-shaped member mounted on a drive spindle contained within the cradle assembly so that a plurality of blades can be spun relative to the grinding plane of the grinding wheel for rapidly resharpening a selected surface of all of the blades in any given orientation of the blades to the grinding wheel plane.

Considering the invention in a specific form in which it will be initially manufactured, it is intended that certain types of cutting blades be handled by applicants' machine. These blades are of a type which include at least (a) a first side relief surface, (b) a topland surface, (c) a curved surface interconnecting the first side relief surface and the topland surface, and (d) a second side relief surface, (as disclosed in U.S. Pat. No. 3,881,889 and in commonly owned application Ser. No. 741,837, filed on Nov. 15, 1976, now U.S. Pat. No. 4,060,881 by Ryan and Thomas, for example). Certain forms of these blades may additionally include a curved surface interconnecting the topland surface and the second side relief surface. Cutting blades of this type have protected front (or chip) faces which do not require resharpening. A preferred machine for sharpening blades of this type includes a tool-holding ring for carrying a plurality of blades with their end portions projecting beyond a circumference thereof, a driving means for spinning the tool-holding ring relative to a grinding wheel, a cradle assembly for supporting the tool-holding ring in separate positons for grinding the cutting blade surfaces (a)-(d) and in the same grinding plane and area of the grinding wheel, and control means for moving the cradle assembly to the separate positions. One of the features of the apparatus is its provision for turning a cradle body portion of cradle assembly over to a position in which opposite sides of a plurality of cutting blades can be ground as the tool-holding ring spins the blades in contact with the grinding wheel. This is accomplished with means for turning the cradle body and its contained tool-holding ring over in a cradle axis and this further requires a drive train for maintaining driving contact between a drive motor and the tool-holding ring for all positions in which the cradle body may be turned for grinding opposite surfaces of the cutting blades. Additionally, a separate cradle base of the cradle assembly is provided with a pivotal mounting relative to the base structure of the machine so that the cradle assembly can be swung about a reference axis which is used to establish correct positioning of the cutting blades relative to the grinding plane and to provide for generation of curved surfaces interconnecting the side relief surfaces and the top-land surfaces of the cutting blades. Adjustment features are included to provide for a full range of positions of different shapes of cutting tools relative to the reference axis and grinding plane for the machine.

Thus, the present invention offers specialized equipment for carrying out the basic method of resharpening described in U.S. Pat. No. 3,881,889 and the specific method described in co-pending U.S. Application Ser. No. 812,197. These methods can be carried out at high production rates and with complete control of dimensional and geometric relationships of the cutting blades being sharpened. As a result, greater productivity (and therefore lower cost) of manufacturing can be achieved with the specialized grinding equipment of this invention.

These and other features and advantages of the invention will become apparent in the more detailed discussion that follows, and in that discussion reference will be made to the accompanying drawings as briefly described below.

DETAILED DESCRIPTION OF INVENTION

Figure 1:
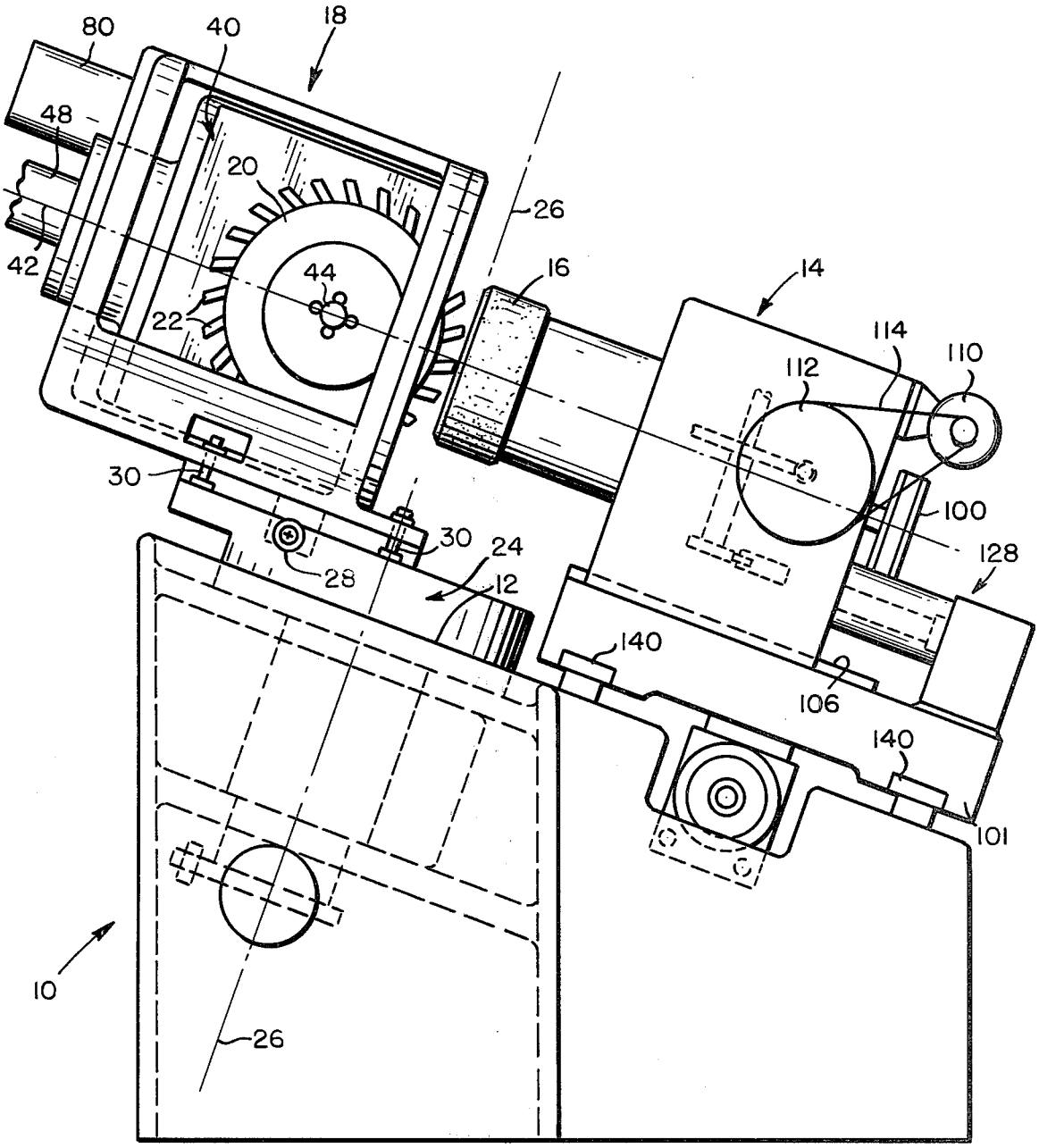
FIG. 1 is an elevational view of the apparatus of the present invention.
Figure 2:
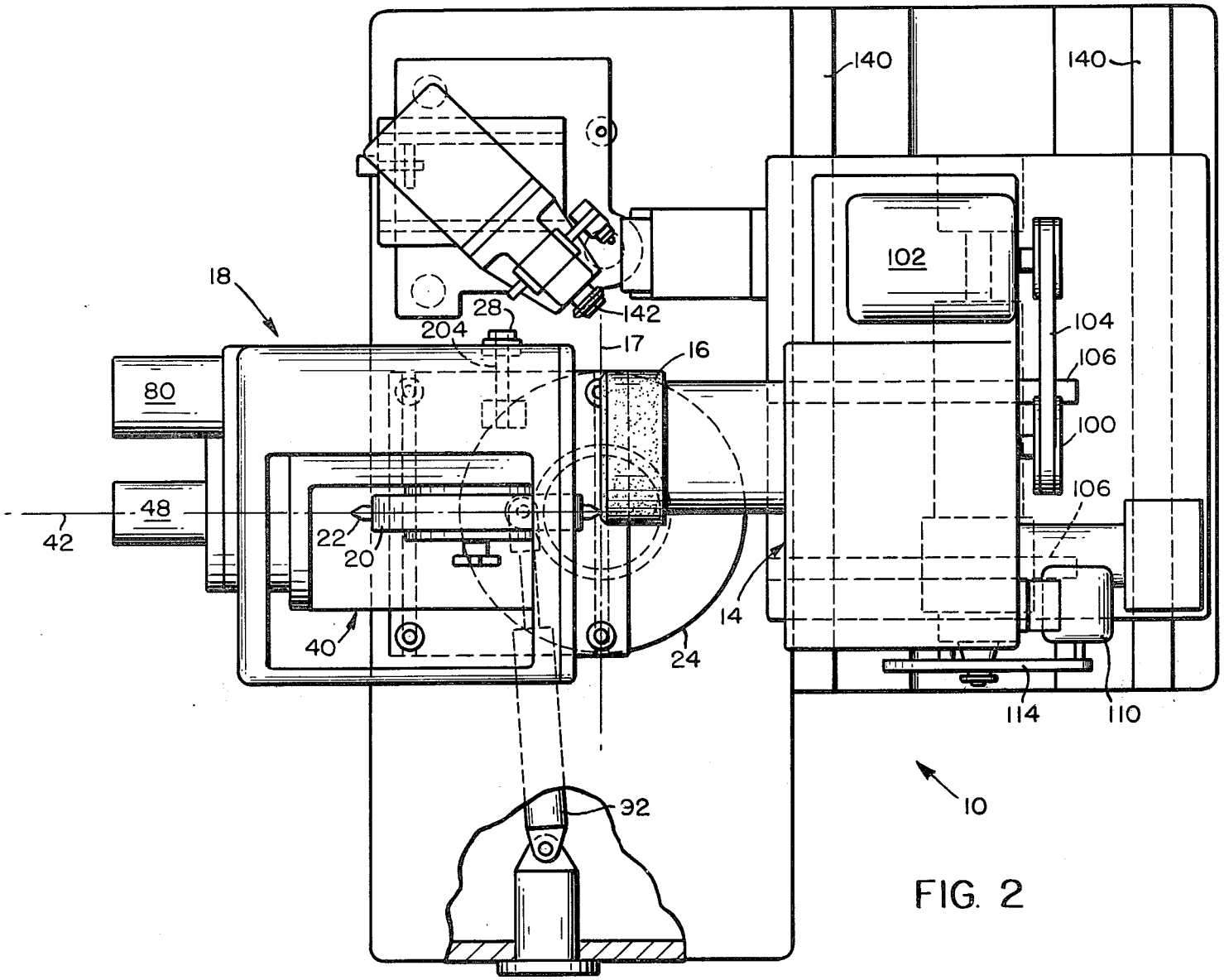
FIG. 2 is a top plan view of the apparatus of FIG. 1.

FIGS. 1 and 2 illustrate the basic layout of components of the machine of this invention. As shown in FIG. 1, the machine includes a base structure 10 having an inclined upper surface 12 for supporting essential components of the machine. The supported components include a grinding wheel assembly 14 mounted at a lower level end of the inclined upper surface 12 for supporting a grinding wheel 16 having a grinding face which can be located in a grinding plane 17 and directed toward an upper end of a base structure 10. A cradle assembly 18 is mounted at an upper level end of the inclined upper surface 12 of the base structure for supporting and positioning a plurality of cutting blades 22 relative to the grinding face of the grinding wheel 16. A tool-holding means, comprising a ring-shaped holder 20, is mounted within the cradle assembly 18 for securing the plurality of cutting blades 22 in serial positions which permit orientation of common selected surfaces of the cutting blades toward the grinding face of the grinding wheel 16. The inclined upper surface 12 of the base structure 10 provides for a more accessible arrangement of the tool-holding means and of control components at the upper level end of the machine and also provides for better control of coolant flow into and out of the grinding zone of the machine. Additionally, the illustrated arrangement provides for a rigid and positive positioning of the grinding wheel 16 as it is advanced toward the cradle assembly 18. Retraction movements of the grinding wheel assembly 14 away from the cradle assembly 18 take advantage of gravitational pull on the grinding wheel assembly in its position on the inclinded surface 12.

The cradle assembly 18 is mounted on a cradle base 24 which in turn is mounted on the base structure 10 so as to rotate on a pivot axis 26 which defines a reference axis about which the cutting blades 22 are moved relative to the grinding face of the grinding wheel 16. As will be discussed in greater detail with reference to FIG. 5, means are provided for controlling pivotal movements of the cradle base 24 about its axis 26 so as to carry the entire cradle assembly 18 and its contained cutting blades to selected orientations relative to the grinding wheel 16 (including generation of the curved profile that typically connects the end portion and side portion of a blade profile).

Figure 11:
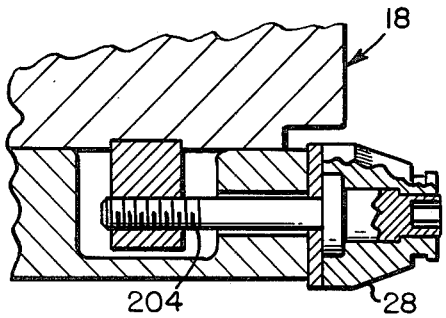
FIG. 11 illustrates a manual adjustment feature associated with the cradle assembly.

In addition to the pivotal movement provided by the cradle base 24, the cradle assembly 18 is mounted relative to the cradle base 24 so that cradle axis 42 is manually adjustable in its off-set position relative to the pivot axis 26. A relatively simple adjustment means 28 (also see FIG. 11) is provided for this type of adjustment which has the effect of moving the entire cradle assembly 18 transversely relative to the cradle base 24 and to the face of the grindng wheel 16. This adjustment is made for set-up purposes, and will be discussed in greater detail with reference to FIGS. 12–16, and is carried out when clamping means 30 are released from their normally clamped conditions for rigidly securing the cradle assembly 18 relative to the cradle base 24.

In addition, the tool-holding means 20 can be adjusted transversely in its position relative to the cradle assembly in which it is mounted. This feature will be discussed in greater detail with reference to FIGS. 3 and 16.

Figure 3:
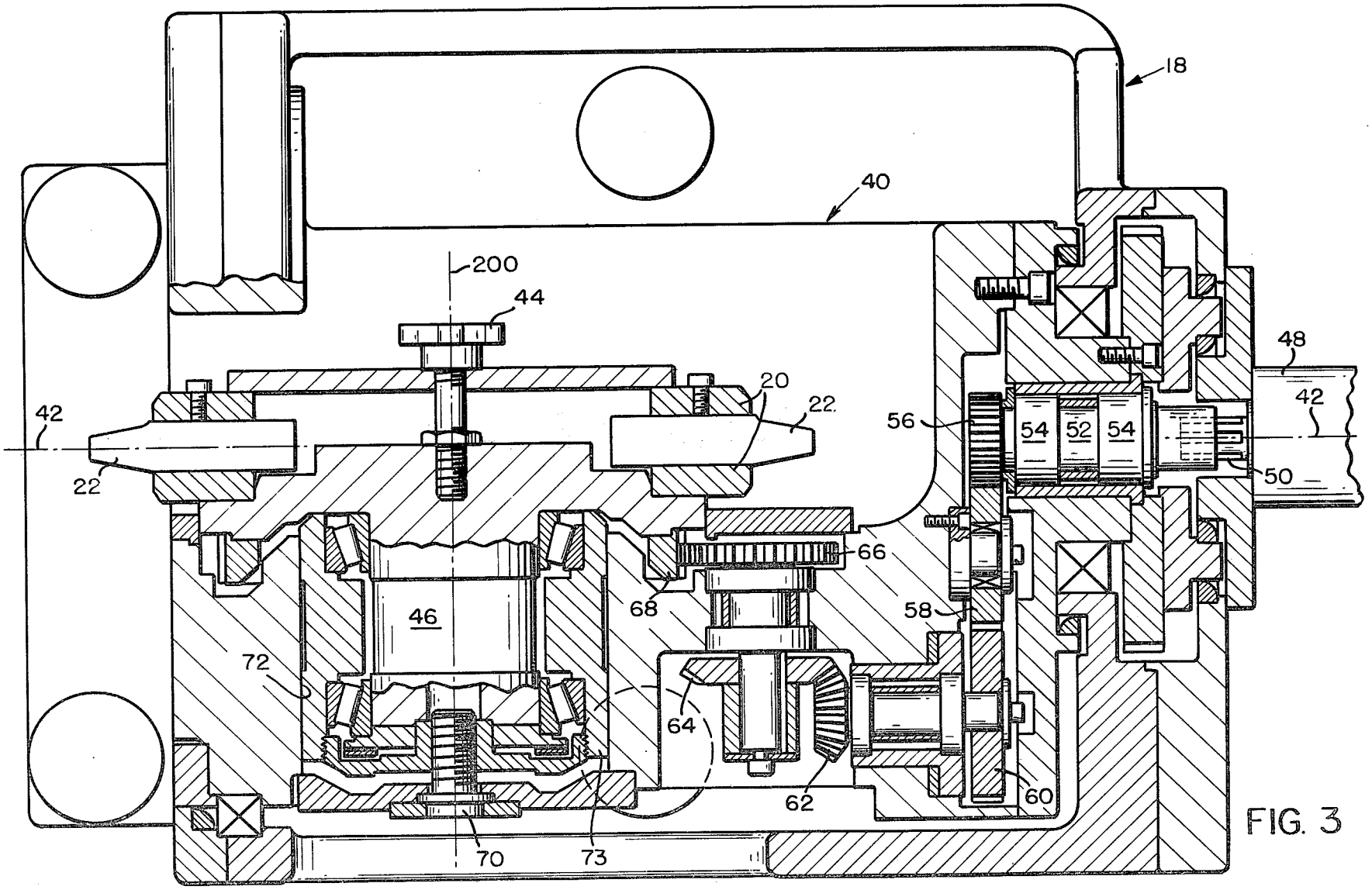
FIG. 3 is a cross sectional view of a tool-holding means and its associated drive train, as seen in a plane bisecting the tool-holding means and a drive motor associated with its drive train. The illustrated components are shown in a reversed layout from the relationships illustrated in FIGS. 1 and 2, and the FIG. 3 view is greatly enlarged from the scale of FIGS. 1 and 2.
Figure 4:
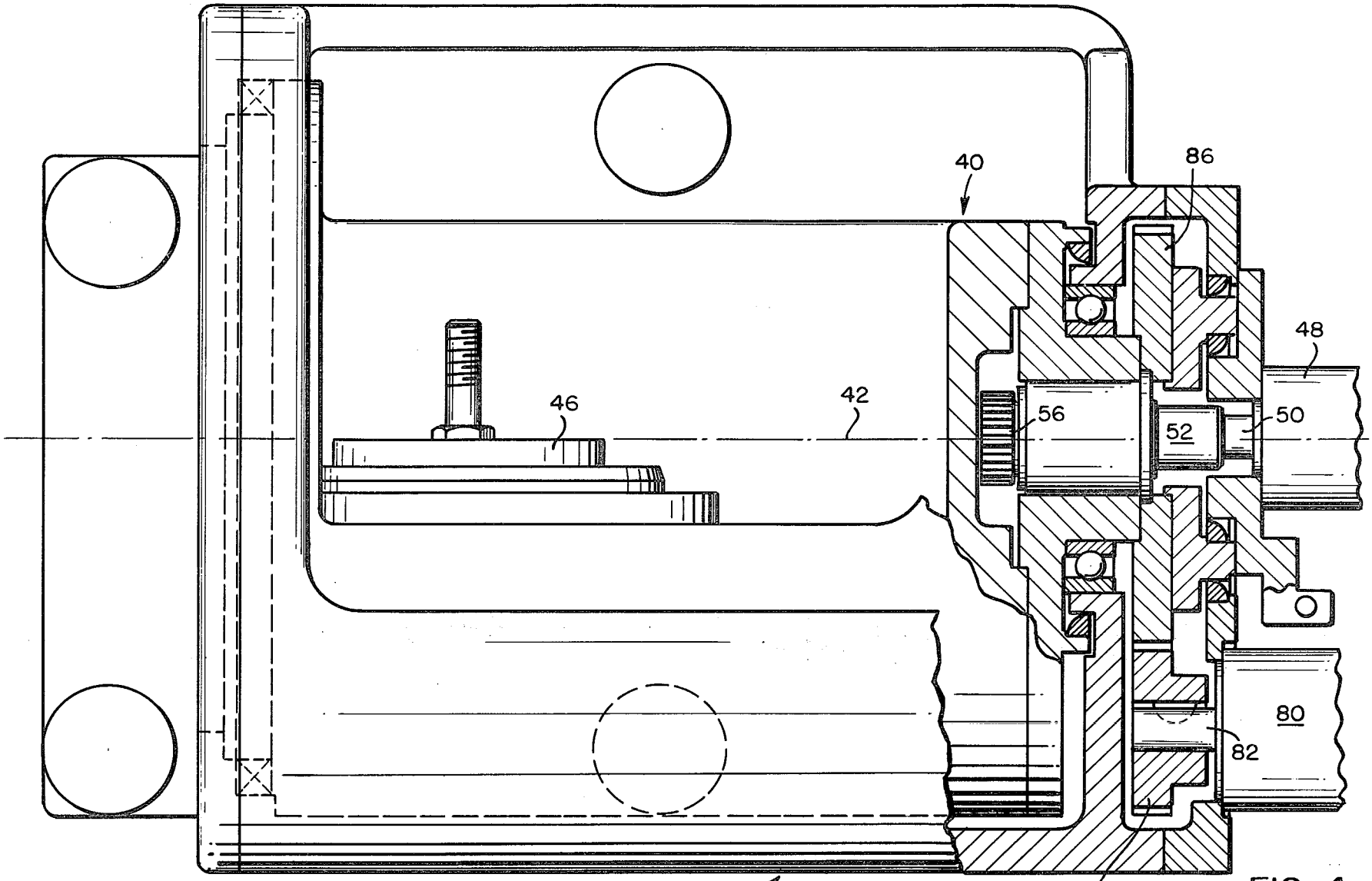
FIG. 4 is a view similar to that of FIG. 3, showing a cradle body portion of the cradle assembly in cross section for purposes of illustrating a means for turning the cradle body over in its axis.
Figure 5:
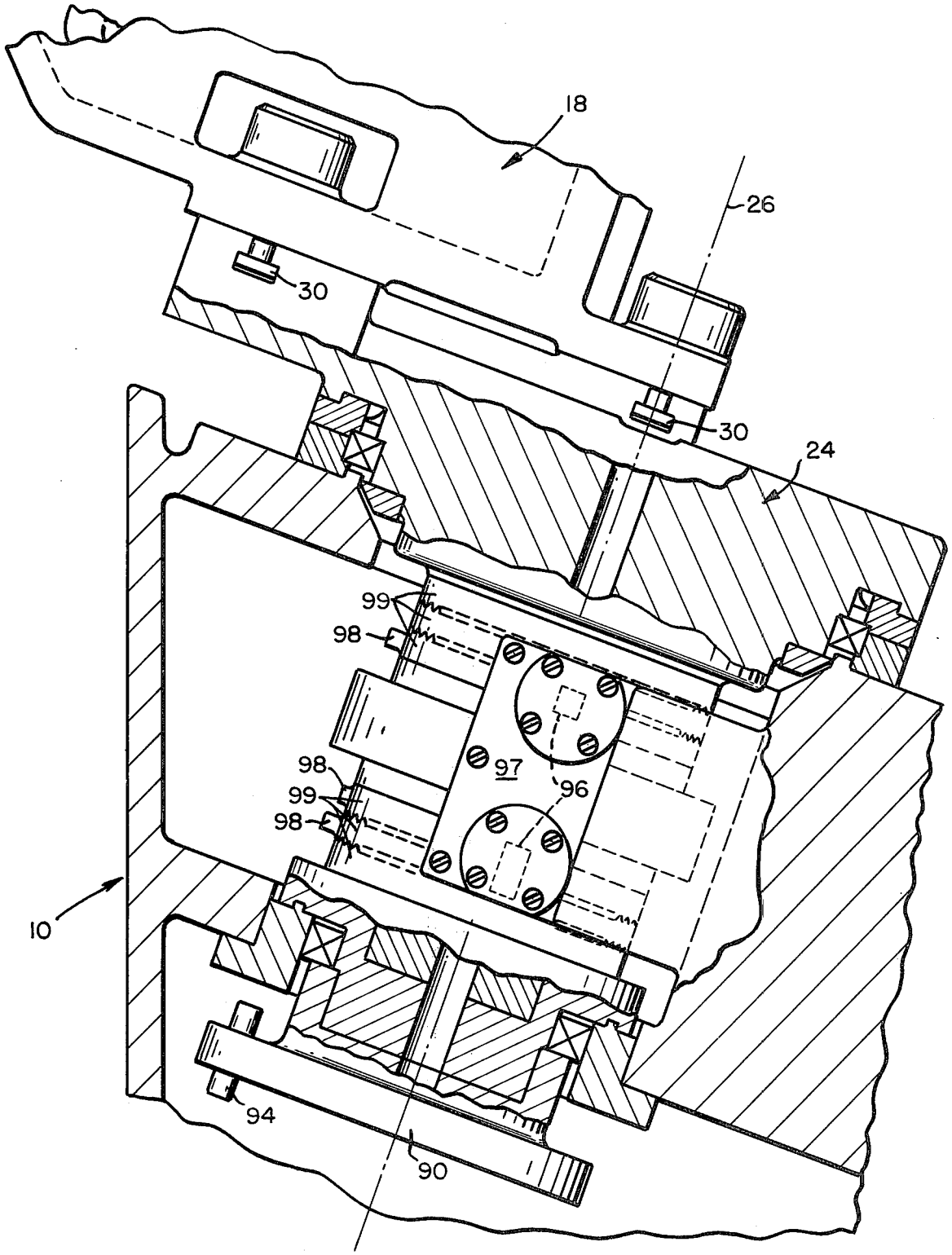
FIG. 5 is an elevational view, partly in cross section, of the pivotal mounting arrangement for mounting the cradle assembly of the machine onto the base structure.

FIGS. 3–5 illustrate details of construction for the cradle assembly and its associated mechanisms. FIGS. 3 and 4 represent views of the cradle assembly 18 as it would appear locking down upon the assembly and with portions cut away in a plane which is generally parallel to the incline of the surface 12 of the machine. FIG. 3 illustrates a drive train for spinning the tool-holding means 20 within a cradle body 40 of the cradle assembly 18, and FIG. 4 illustrates a means for turning the cradle body 40 about a cradle axis 42 within the cradle assembly.

Referring to FIG. 3, it can be seen that the tool-holding ring 20 comprises a ring-shaped holder assembled from two separate disc-shaped members. One of the disc-shaped members comprises a base plate having a very flat mounting surface against which reference surfaces of the tools are mounted. The other disc-shaped member has a plurality of slots formed therein for receiving an equal number of cutting blades in secured positions. The number of slots and cutting blades to be carried thereby may vary according to specific needs, but a production model of the machine provides for sufficient slots to carry thirty six cutting blades in the tool-holding means. The angular setting of the slots establishes top relief angles to be ground on the plurality of blades. Blades are loaded and unloaded manually into and out of the tool-holding means, and it can be appreciated that additional tool-holding means can be provided for any given machine so that blades can be loaded into a demounted holder while a plurality of blades are being ground in a separate holder mounted on the machine. This feature eliminates long set-up times on the machine itself and permits maximum usage of the machine with very little down time for changing holders. As shown, the tool-holding means 20 is secured to a drive spindle 46 with a fastening nut 44. The drive spindle means 46 is, in turn, operatively connected to a drive motor 48 through a drive train which includes: an output shaft 50 from the drive motor 48, a connecting shaft 52 mounted through a pair of bearings 54 for driving spur gears 56, 58, and 60, which transmit their turning moments to a pair of bevel gears 62 and 64 for driving a final spur gear 66. The final spur gear 66 engages and drives a ring gear 68 secured to a flange portion of the drive spindle 46, and thus rotary motion from the drive motor 48 is carried to the drive spindle 46. All of the drive train structures just described are mounted in such a way that driving engagement is maintained between the drive motor 48 and the tool-holding means 20 for all positions of the cradle body 40 relative to the cradle assembly 18. In addition, the major part of the drive train is carried by the cradle body 40 so that the drive train follows turning movements of the cradle body 40 about its cradle axis 42. The drive motor 48 is mounted with its axis of rotation coincident with the cradle axis 42 and is fixed to the cradle assembly 18 so that it does not have to turn with the turning movements of the cradle body 40. Gear ratios for the drive train can be selected to provide whatever speed range may be desired for spinning the tool-holding means, and a final speed of twenty to fifty rotations per minute is suggested for sharpening gear cutting blades of the type contemplated herein. Drive motor 48 may comprise any known form of motor means, and a variable speed hydraulic motor can be used for this purpose.

In addition to the drive train structures discussed above, FIG. 3 also illustrates an adjustment means for transversely shifting the tool-holding means 20 to provide for different set-up positions of the tool 22 relative to the turning axis 42 for the cradle body. The adjustment means includes a manually operated screw 70 for advancing or retracting the drive spindle housing 73 relative to a bore 72 in which it is mounted. A separate, exterior locking means is provided. It can be seen that the ring gear 68 is of a sufficient width to permit limited adjustment of the drive spindle relative to the spur gear 66 with which it meshes. The purpose in providing for this adjustment feature is one of establishing the required position of the profile of each cutting blade relative to the cradle axis 42, as viewed in the FIG. 3 orientation. This feature will be discussed with reference to FIGS. 12–16.

FIG. 4 illustrates a separate drive mechanism for turning the cradle body 40 over within the cradle assembly 18. As previously discussed, the cradle body 40 is fitted within the cradle assembly 18 for being turned over in its axis 42, and this motion provides for a complete turning over of the tool-holding means 20 carried by the cradle body 40. A separate motor means 80 is fixed to a non rotating portion of the cradle assembly 18 so that its output shaft 82 can transmit a driving moment to a spur gear 84 carried thereby. The spur gear 84 meshes with and drives a larger spur gear 86, and the larger spur gear 86 is secured to the cradle body 40. Thus, the larger spur gear 86 can rotate the cradle body 40 to a selected attitude determined by conventional control devices which are not illustrated and which do not form a separate part of the present invention. Use of this feature will be described with reference to FIGS. 12–16. Additionally, sufficient control devices can be provided for not only establishing working positions for the cradle but also for establishing a convenient cradle position for loading and unloading the tool-holding means.

FIG. 5 is an elevational view of a pivotal mounting assembly for the cradle assembly 18 and its associated cradle base 24. Portions of the drawings have been cut away in a vertical plane which lies on the pivot axis 26. As previously discussed, the entire cradle assembly 18 can be swung about the pivot axis 26 so that the cutting blades contained within the tool-holding means 20 can be brought into different positions relative to the grinding plane 17. The different positions which result from this pivotal movement of the cradle assembly 18 can be seen in the FIGS. 12 and 13 views. In order to provide for swinging movements of the entire cradle assembly 18, the cradle base 24 (to which the cradle assembly 18 is normally clamped) is provided with a downwardly extending spindle assembly having a drive plate 90 secured to a lower end thereof. The cradle base 24 and its associated spindle assembly structures are mounted and supported within the framework of the base structure 10 in such a way that the entire load of the cradle assembly 18 can be carried and rotated about the axis 26 when the drive plate 90 is moved by a hydraulic ram 92 (see FIG. 2) interconnected between a stationary portion of the base structure 10 and a drive pin 94 associated with the drive plate 90. Movements of the hydraulic ram 92 are controlled with known, conventional devices. Limit positions of the pivotal movement of the cradle assembly (about the axis 26) are set by fixed stops 96 and adjustable stops 98. The fixed stops 96 are mounted in a fixed structure 97 secured to a protion of the base structure 10 and include projecting elements that can be moved (by hydraulic means) into and out of the path of travel of the adjustable stops 98. In this way, more than two limit positions can be provided for pivoting the cradle inasmuch as a stop 96 can be withdrawn momentarily while a stop 98 bypasses it, followed by a movement of the stop 96 back into a position for intercepting a different stop 98 carried by one of the face coupling members 99. The face coupling members 99 can be separated and rotated relative to each other to provide for very precise (within one minute) repositioning of the stops 98 about the stack of coupling members 99.

Figure 6:
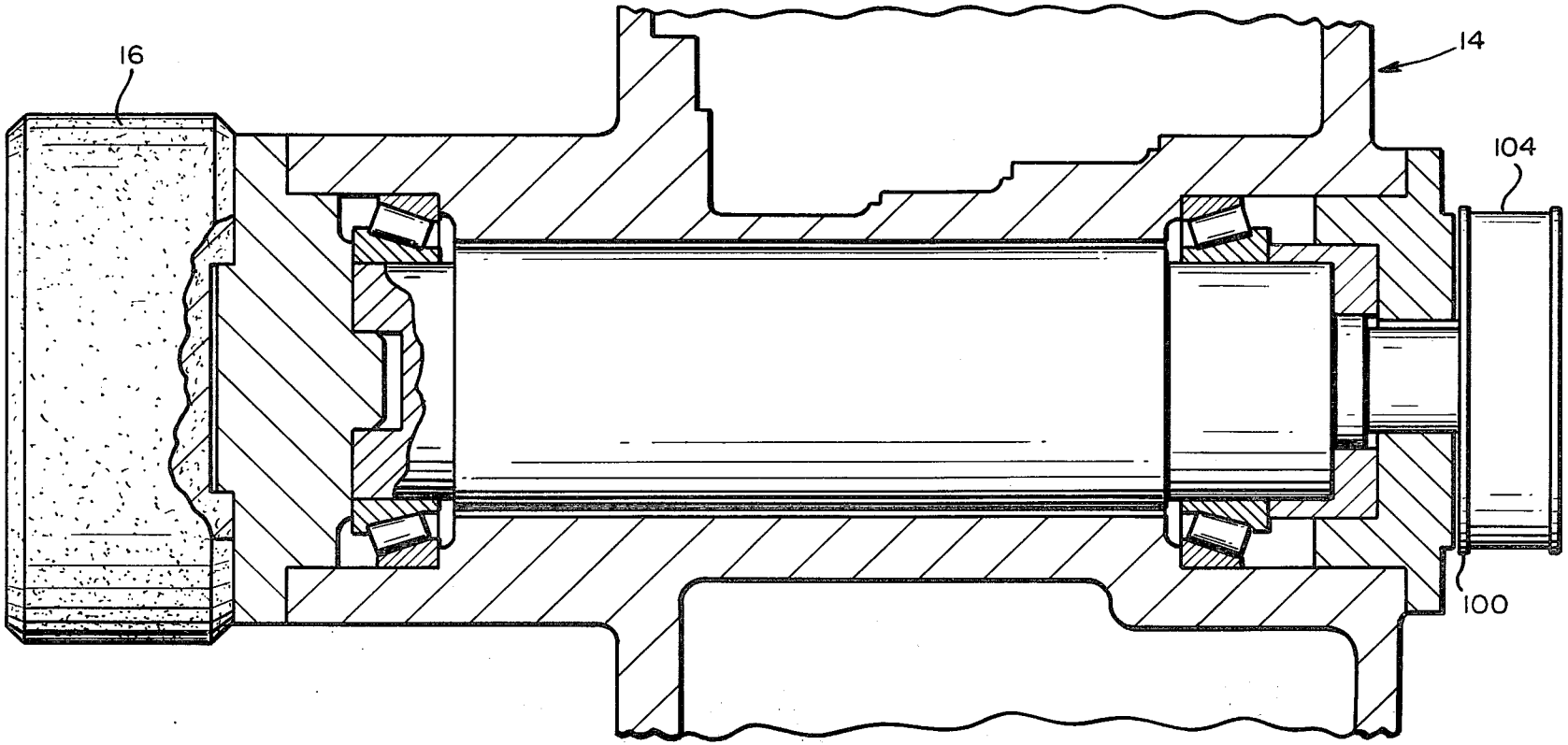
FIG. 6 is a side elevational view, partly in cross section, of a grinding wheel and an associated mounting spindle and means for driving the grinding wheel.

Turning now to the grinding end of the machine, FIGS. 6 through 10 illustrate details of the various assemblies associated with the grinding wheel assembly 14. As shown in FIG. 6, the grinding wheel 16 comprises a cup-shaped grinding wheel of known composition and manufacture, and this grinding wheel is rigidly mounted for rotation through a portion of the housing associated with the grinding wheel assembly 14. The grinding wheel 16 is driven by a pulley 100 interconnected to the grinding wheel itself, and the pulley 100 receives its driving moment from a reversible drive motor 102 (see FIG. 2) and a drive belt 104.

Figure 7:
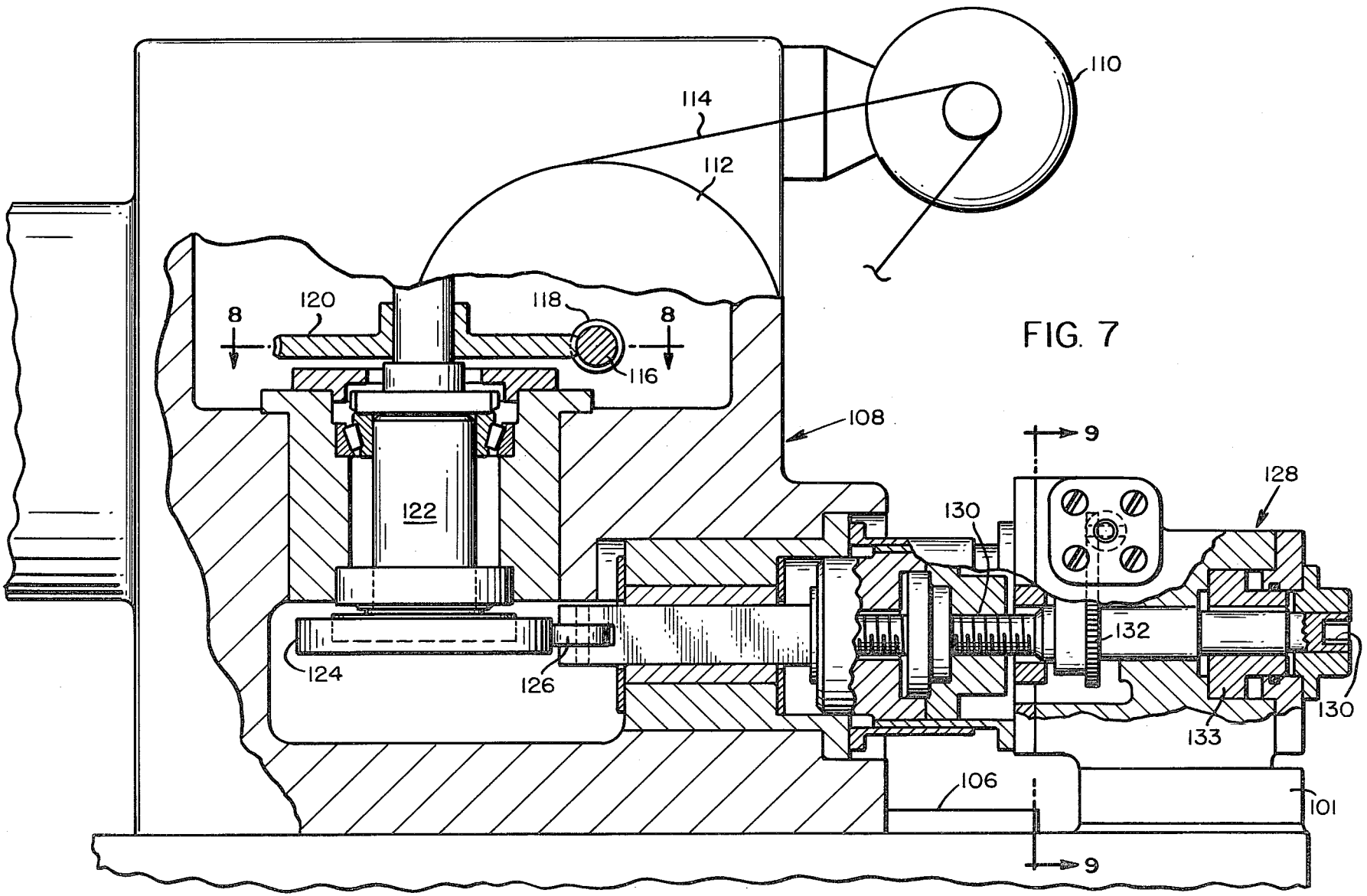
FIG. 7 is a side elevational view, partly in cross section, for illustrating a mechanism for advancing the position of the grinding wheel toward and away from the position of the cradle assembly.
Figure 8:
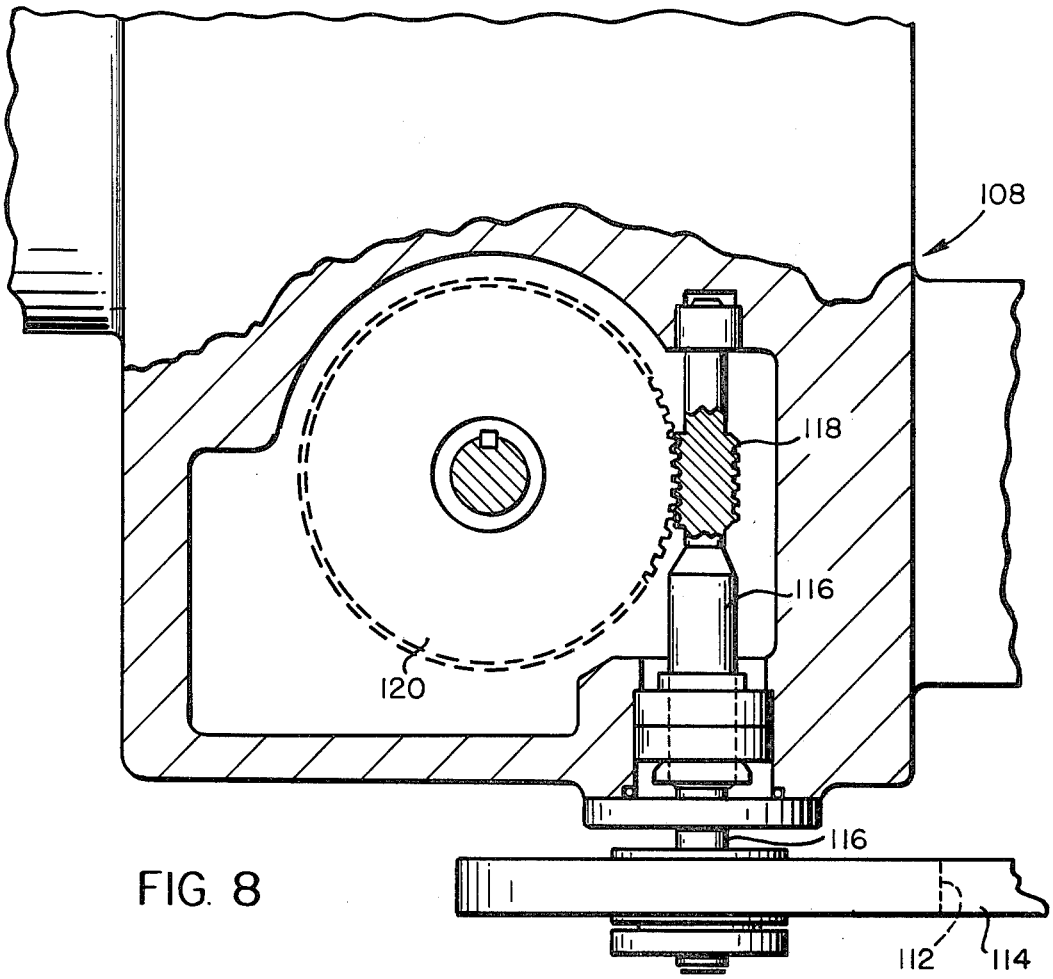
FIG. 8 is a top plan view, partly in cross section, of certain portions of FIG. 7 as seen on line 8—8 thereof.
Figure 9:
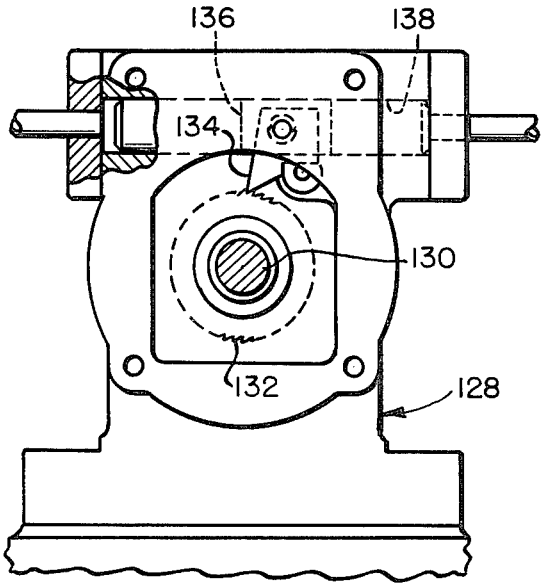
FIG. 9 is an end elevational view, partly in cross section of a mechanism for adjusting the position of the grinding wheel to advance the grinding wheel for dressing purposes, as seen generally on line 9—9 of FIG. 7.

The grinding wheel assembly 14 is mounted on ways 106 (see FIGS. 1 and 2) for being advanced and retracted toward and away from the cradle assembly 18. This provides for engagement and disengagement of the grinding wheel 16 with the tooling to be sharpened. FIGS. 7–9 illustrate details of a mechanism for controlling the advancing and retracting movements of the grinding wheel towards and away from the cradle assembly.

As shown in FIG. 7 a moveable portion 108 of the grinding wheel assembly is mounted on ways 106 for being advanced and retracted toward and away from the cradle assembly 18. A variable speed drive motor 110 is mounted on the moveable portion 108 and serves to drive a large pulley 112 through a drive belt 114. As shown in FIG. 8, the large pulley 112 is secured to a drive shaft 116 having a worm gear 118 secured thereto. The worm 118, in turn, drives a gear wheel 120 for rotating a spindle 122 (FIG. 7) and a cam 124 carried at a lower end thereof. The cam 124 is shaped to define a cycle of advancing and retracting movements for the entire assembly 108. The circumferential profile of the cam 124 bears against a follower 126 which is operatively connected to a fixed housing 128 secured to a cross-slide member 101, and the fixed housing 128 does not move toward and away from the position of the cradle assembly during normal cycling of the machine. It can be seen that the position of the follower 126 can be adjusted manually with a screw adjustment 130 so that the position of a new grinding wheel 16 can be set relative to a dresser. In addition, provision is made for automatically feeding the position of the follower 126 in a way which advances the grinding wheel 16 during a grinding cycle for dressing purposes. This automatic feed is achieved with a known device, illustrated in FIGS. 7 and 9, for imparting incremental turns to the screw means 130 which adjusts the position of the follower 126.

The automatic adjusting device of FIG. 9 includes a ratchet wheel 132 secured to the adjustment screw 130. A pawl 134 periodically engages successive teeth on the ratchet wheel in accordance with reciprocations of a piston 136 carried within a cylindrical chamber 138. Reciprocations of the piston 136 can be achieved through the admission and venting of oil into and out of the chamber 138 in accordance with known techinques and with provision for adjusting the number of reciprocations in order to dress a desired amount of material from the grinding wheel 16. A separate clamping piston 133 is provided for locking the adjusting device between incremental steps of turning.

Figure 10:
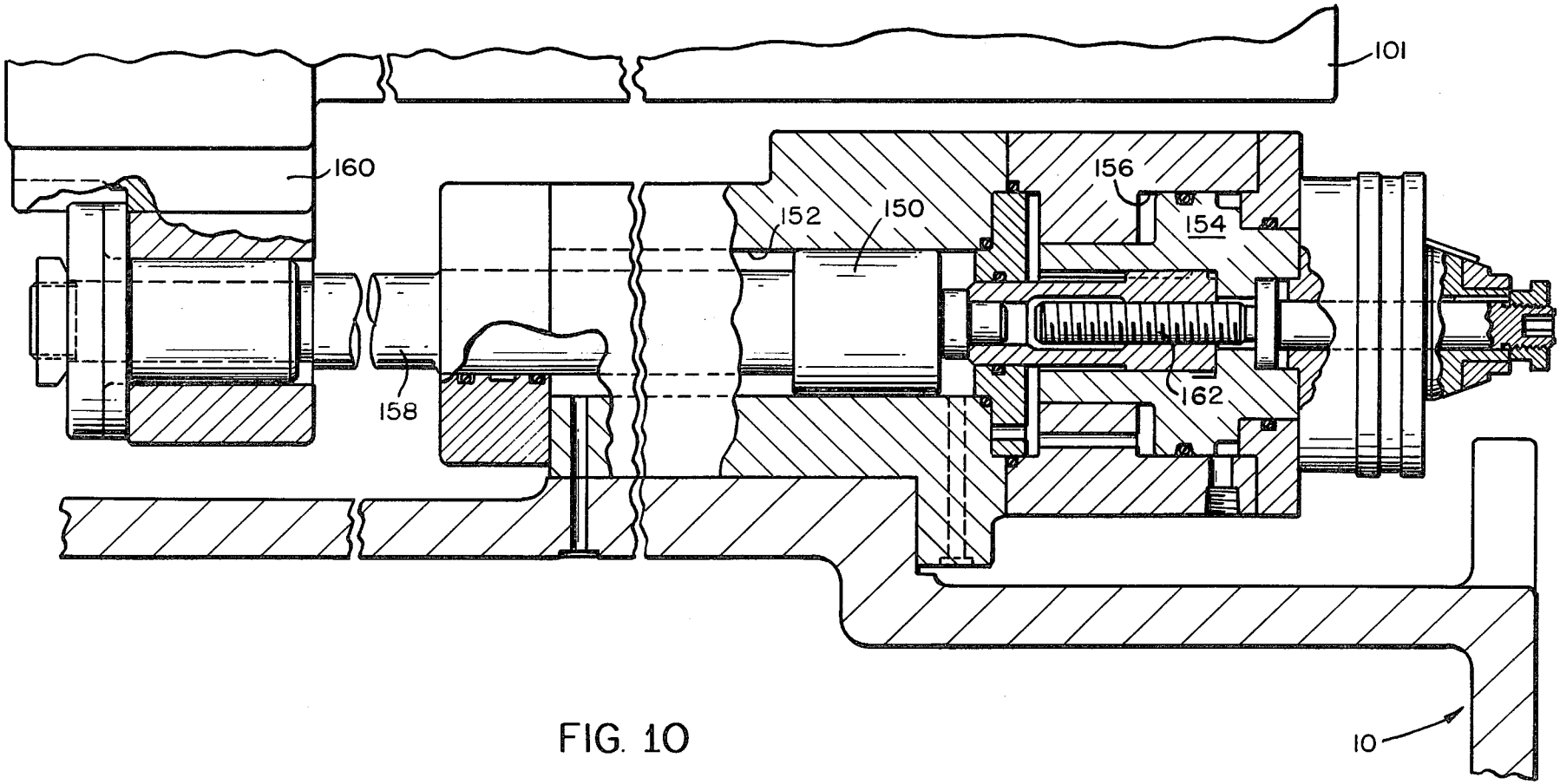
FIG. 10 is a side elevational view, partly in cross section, of a traversing means for moving the grinding wheel assembly between a position for grinding and a position for being dressed.

FIG. 10 illustrates a traversing means for moving a cross slide 101 along ways 140 so that the grinding wheel assembly 14 can be moved from a position for grinding workpieces (as shown in FIG. 2) to a position where the grinding wheel can be dressed by a dressing mechanism 142 (towards the top of FIG. 2). This position is also used for unloading the workholder. Typically, the grinding wheel is dressed several times during each operation of the grinding cycle, and it is possible to provide for a rapid movement of the grinding wheel 16 to a position for being dressed by the dressing device 142 whenever the tool-holding means 20 is being repositioned to present different surfaces for being sharpened.

Basically, the traversing means of FIG. 10 comprises a hydraulic ram which includes a primary piston 150 fitted within a cylinder 152 and a secondary piston 154 fitted within a cylinder 156. The primary piston 150 is actuated with hydraulic fluid to provide a major traverse of the grinding wheel assembly between its grinding and dressing positions. Movement of the piston 150 is transmitted through a piston rod 158 to the moveable cross-slide 101 on which the grinding wheel assembly is carried. The secondary piston 154 functions to provide for a small change in the lateral positioning of the grinding wheel assembly between the rough grinding and finish grinding sequences. In addition, a screw member 162 can be manually adjusted for precisely setting the lateral position of the grinding wheel assembly 14 relative to the pivot axis 26.

Having discussed constructional details of this invention, it is now possible to appreciate the type of precision grinding operation that can be carried out with such a machine. FIGS. 12 through 15 illustrate a series a sequential steps that can be carried out in a fully automated cycle of the machine when used for sharpening a particular form of cutting blade that does not require a sharpening of its front (chip) face. Surfaces which are to be sharpened include (see FIG. 16) a topland surface 180 (at the end of each cutting blade), a first side relief surface 182, and a second side relief surface 184. These three surfaces represent critical surfaces which must be sharpened within carefully controlled tolerances. In addition, it is desirable to provide for a blending of each end of the topland surface 180 with the side relief surfaces 182 and 184 so as to produce rounded corners at the end of each cutting blade.

Figure 12:
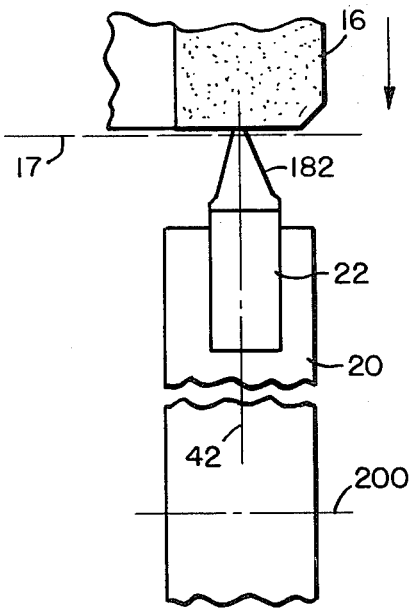
FIG. 12 is a top plan view of basic relationships between a tool-holding means, a single cutting blade, and a grinding wheel during formation of topland surfaces on a plurality of blades carried by the tool-holding means.

FIG. 12 illustrates a starting position for a grinding cycle. At the beginning of the cycle the tool-holding means 20 is spinning about its axis 200 with a batch of cutting blades 22 mounted therein for sharpening. The cradle axis 42 is positioned at a perpendicular to a theoretical grinding plane 17, and the grinding wheel 16 is advanced toward the cutting blades until its grinding surface is in the grinding plane 17. This advancement of the grinding wheel results in a formation of a topland surface 180 on all cutting blades contained within the tool-holding means.

Figure 13:
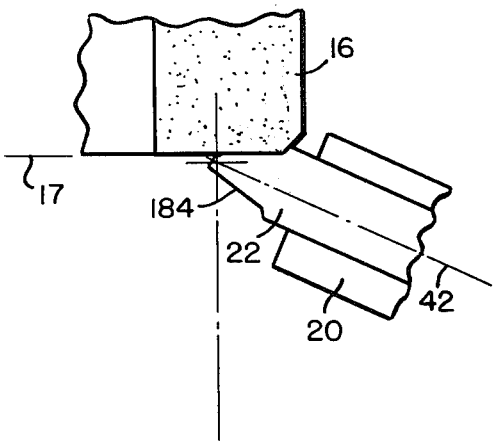
FIG. 13 illustrates basic relationships for forming first side relief surfaces on a plurality of blades carried by the tool-holding means as the tool-holding means spins relative to the grinding wheel.

A second step of the cycle involves a swinging movement of the cradle assembly 18 about the pivot axis 26. This is carried out through a controlled actuation of the ram 92 (FIG. 2) as previously described, and the effect of this motion is to provide a rounded corner between the topland surface 180 and the side relief surface 182. Eventually the relationship of the cutting blades and the grinding wheel are as shown in FIG. 13, and this provides for a sharpening of the first side relief surface 182 on all of the cutting blades contained within the tool-holding means.

In order to carry out a correct blending of the topland surface 180 with the side relief surface 182, as just described, it is necessary that the pivot axis 26 pass through a point 202 (see FIG. 16) of each cutting blade 22 as the cutting blade is brought into full engagement with the grinding wheel 16. Correct positioning of the cradle assembly for this purpose is achieved by a manual adjustment screw 204 (see FIGS. 2 and 11) which is used for intially setting the transverse position of the cradle assembly 18. In order to carry out this adjustment it is necessary to unclamp the cradle assembly 18 from its cradle base 24 so that the cradle assembly can be traversed on ways provided for this purpose.

Figure 14:
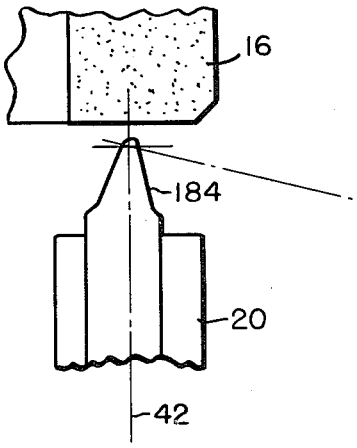
FIG. 14 illustrates a disengagement of the grinding wheel and tool-holding means so that the entire tool-holding means can be turned over.
Figure 15:
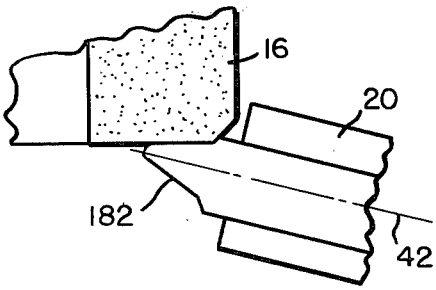
FIG. 15 illustrates a final step of forming second side relief surfaces on all blades when the tool-holding means in its turned over attitude.
Figure 16:
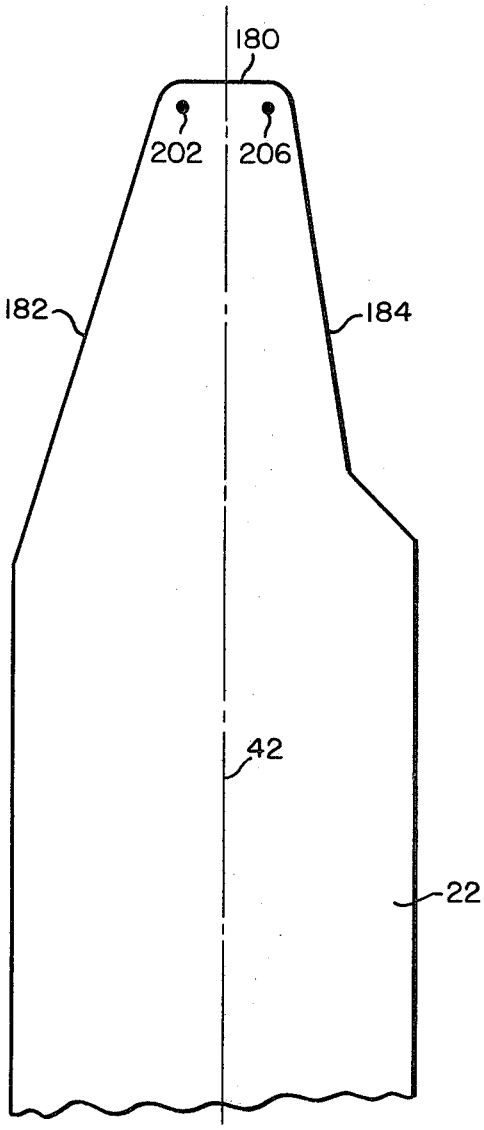
FIG. 16 illustrates reference planes and points on a single cutting blade.

FIG. 14 illustrates a step in a cycle in which the grinding wheel 16 is withdrawn from contact with the cutting blades being sharpened so that the tool-holding means can be completely turned over in its axis 42 to present an opposite side of all cutting blades to the same area of the grinding face of the grinding wheel 16 as was used for grinding the other surfaces of the blades. As shown in FIG. 16, the cradle axis 42 is set to bisect the width of the topland 180 (through an adjustment of position of the tool-holding means 20 with the adjustment screw 70 shown in FIG. 3). This setting results in reference point 206 being positioned exactly on reference axis 26 when the tool-holding means is flipped over 180° to the position shown in FIGS. 14 and 15, and thus, a curved profile can be formed between the topland surface 180 and the second side relief surface 184 when the cradle assembly 18 is swung about the reference axis 26 to the position shown in FIG. 15. Each of the curved profiles formed at the end of each blade constitutes a segment of a circle having a radius equal to the distance from the circumference of the curved profile to its associated reference point 202 or 206.

An important feature of the invention is its provision for setting the precise position of the grinding plane 17 through a precise control of position of the dressing mechanism 142. This obviates a need for attempted control of the grinding plane through precision adjustments and movements of heavier components of the machine. Thus, in setting up the machine, the cradle and tool-holder positions are set as closely as possible to desired positions, and then, a final precision setting of the dressing mechanism is made to achieve desired tolerances on the order of 0.0002 inch.

Of course, the apparatus can be used differently than described above, and it is contemplated that many precision sharpening procedures will involve additional steps to those discussed above. For example, it may be preferred to provide additional steps of disengagement of the grinding wheel from the cutting blades so that the grinding wheel can be dressed more frequently or so that a more precise reengagement can be achieved with a minimum of interference between shoulder portions of the grinding wheel and portions of the cutting blades being sharpened. Variations in technique and operation will be apparent to those skilled in this art. Other forms and shapes of grinding wheels may be utilized, relative advancement and withdrawal of the cutting blades and the grinding wheel can be achieved by moving the cutting blades as well as by moving the grinding wheel, and profile shapes which are curved rather than flat can be produced on relief surfaces of cutting blades, if desired. Other variations and modifications will be apparent to persons skilled in this art and those variations and modifications which are fully equivalent to what has been described herein are intended to be included in the scope of the claims of this invention.

What is claimed is:

1. A machine for high speed, production grinding of critical surfaces on cutting blades of a type designed for use in precision cutting operations, such as in gear cutting operations, comprising a base structure having an inclined upper surface for supporting essential components of the machine, a grinding wheel assembly mounted at a lower level end of the inclined upper surface of the base structure for supporting a grinding wheel having a grinding face directed toward an upper end of the base structure, a cradle assembly mounted at an upper level end of the inclined upper surface of the base structure for supporting and positioning a plurality of cutting blades relative to the grinding face of said grinding wheel, a tool-holding means for securing said plurality of cutting blades in serial positions which permit orientation of a common selected surface on all of the cutting blades toward said grinding face of said grinding wheel, said tool-holding means being mounted in said cradle assembly for being turned over in a cradle axis to thereby turn over all of said plurality of blades in their relative orientation to said grinding wheel, and control means for relatively moving said grinding wheel assembly and said cradle assembly to thereby advance selected surfaces of said cutting blades into the grinding plane of said grinding wheel.

2. The machine of claim 1 wherein said grinding wheel comprises a cup-shaped grinding wheel, and wherein said control means includes means for advancing and retracting the grinding wheel relative to a plurality of cutting blades carried by said cradle assembly.

3. The machine of claim 1 and including a dressing device and traversing means for moving said grinding wheel back and forth between a position for being dressed by said dressing device and a position for grinding said cutting blades and for moving the grinding wheel relative to the dressing device.

4. The machine of claim 1 and including a dressing device for maintaining said grinding plane of said grinding wheel, said dressing device and said grinding wheel being mounted for relative movement so that adjustment of relative position of the dressing device can serve to adjust the position of a profile to be produced on a plurality of cutting blades brought into engagement with the grinding wheel.

5. The machine of claim 1 wherein said tool-holding means includes a ring-shaped member having tool-receiving slots therein for receiving and securing a plurality of cutting blades or other tools for being sharpened, said ring-shaped member being mountable on a drive spindle means carried by said cradle assembly, and including drive means for rotating the drive spindle means and the tool-holding means carried thereon.

6. The machine of claim 1 and including a cradle base for carrying said cradle assembly, said cradle base being mounted on said base structure so as to rotate on a pivot axis which defines a reference axis about which said cutting blades are moved relative to the grinding plane of said grinding wheel, and wherein said cradle assembly is mounted for transverse adjustment on said cradle base so that the positions of cutting blades carried in the cradle assembly can be adjusted relative to said reference axis.

7. The machine of claim 1 and including adjustment means for adjusting the position of said tool-holding means within said cradle assembly relative to a pivot axis about which the cradle can be turned.

8. In a machine for high production, precision grinding of critical surfaces of cutting blades of a type which include (a) a first side relief surface, (b) a topland surface, (c) a curved surface interconnecting said first side relief surface and said topland surface, and (d) a second side relief surface, said machine having a grinding wheel with a substantially flat grinding plane for contacting and grinding said surfaces (a), (b), (c), and (d) of said cutting blades, the improvement comprising:

tool-holding means for securing a plurality of said blades during a grinding operation which moves said plurality of blades relative to said flat plane of said grinding wheel, said tool-holding means further including:

a ring-shaped member for carrying said plurality of blades with their end portions projecting beyond a circumference thereof, driving means for spinning said ring-shaped member and its contained blades relative to said grinding wheel, a cradle assembly for supporting said blade-holding ring in separate positions for grinding said cutting blade surfaces (a)–(d) in the same grinding plane and area of said grinding wheel, and said tool-holding means being mounted in said cradle assembly for being turned over in a cradle axis to thereby turn over all of said plurality of blades in their relative orientation to said grinding wheel, and control means for moving said cradle assembly to said separate positions, whereby said machine can function to grind critical surfaces of said plurality of cutting blades at a high production rate by spinning said tool-holding means and its contained blades in a first position of contact with said grinding wheel to produce said first side relief surfaces of all of the contained blades, and thereafter turning said tool-holding means over to a second position for spinning its contained blades in contact with the grinding wheel to produce said second side relief surfaces for all of the contained blades.

9. The improvement of claim 8 wherein said control means includes means for pivoting said cradle assembly around a reference axis which passes through a tip portion of each cutting blade when the cutting blade is in the grinding plane of said grinding wheel.

10. The improvement of claim 9 and including a cradle body within said cradle assembly and further including turning means for turning said cradle body over in a cradle axis thereof.

11. The improvement of claim 10 wherein said driving means for spinning said tool-holding means includes a drive motor having an output shaft mounted to rotate in said cradle axis, and a drive train operatively connected between said drive motor and said tool-holding means, said drive train being carried by said cradle body so as to follow turning movements of the cradle body in its axis.

12. The improvement of claim 10 and including means for adjusting the position of said tool-holding means within said cradle body.

13. The improvement of claim 12 and including means for adjusting the working position of said tool-holding means relative to a pivot axis of the cradle assembly.

14. A machine for high speed, production grinding of critical surfaces on cutting tools, comprising, a base structure for supporting essential components of the machine, a grinding wheel assembly mounted at one end of said base structure for supporting a grinding wheel, a cradle assembly mounted at an opposite end of said base structure for supporting and positioning a plurality of cutting tools relative to a grinding face of said grinding wheel, said cradle assembly further including a cradle body mounted within the cradle assembly, a ring-shaped tool-holding means mounted within said cradle body for securing a plurality of cutting tools while they are being ground by said grinding wheel, drive means for spinning said tool-holding means within said cradle body, and turning means for turning said cradle assembly over in a cradle axis, to thereby provide for a turning of the cradle body to selected positions which bring opposite surfaces of said cutting tools into engagement with said grinding wheel.

15. The machine of claim 14 and including adjustment means for adjusting the set-up position of said tool-holding means within said cradle body.

16. The machine of claim 14 and including adjustment means for adjusting the set-up position of the cradle assembly relative to said base structure.

17. The machine of claim 14 and including control means for relatively advancing and retracting said grinding wheel assembly and said cradle assembly.

18. The machine of claim 17 and including traversing means for moving said grinding wheel assembly between positions for grinding and for being dressed, and including means for dressing the grinding wheel.

19. The machine of claim 14 and including means for pivotally mounting said cradle assembly relative to said base structure so that the cradle assembly, and its contained cutting tools can be swung about a reference axis during a grinding operation.

20. The machine of claim 19, and including stop means for setting limits on the pivotal movement of said cradle assembly about said reference axis.

21. The machine of claim 20 wherein said stop means include (a) fixed stop means which can be moved into and out of the path of travel of moving stop means, and (b) moving stop means which can be set to adjusted positions and which move with pivotal movements of the cradle assembly.

22. The machine of claim 21 wherein said movable stop means are carried on face coupling members which can be precisely adjusted to set positions for the stop means carried thereon.

* * * * *